US011152163B2

(12) United States Patent
Atherton et al.

(10) Patent No.: US 11,152,163 B2
(45) **Date of Patent: *Oct. 19, 2021**

(54) SWITCH BLOCKING DEVICE

(71) Applicants: Zachary Atherton, Augusta, ME (US); Brendan Paradis, Sidney, ME (US)

(72) Inventors: Zachary Atherton, Augusta, ME (US); Brendan Paradis, Sidney, ME (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/872,420

(22) Filed: May 12, 2020

(65) Prior Publication Data

US 2020/0273640 A1 Aug. 27, 2020

Related U.S. Application Data

(63) Continuation of application No. 16/248,877, filed on Jan. 16, 2019, now Pat. No. 10,685,793.

(60) Provisional application No. 62/619,945, filed on Jan. 22, 2018.

(51) Int. Cl.

| | |
|---|---|
| ***H01H 1/42*** | (2006.01) |
| ***H01H 9/20*** | (2006.01) |
| ***H01H 9/28*** | (2006.01) |
| ***H01H 9/32*** | (2006.01) |

(52) U.S. Cl.

CPC ..... *H01H 9/28* (2013.01); *H01H 1/42* (2013.01); *H01H 9/20* (2013.01); *H01H 9/32* (2013.01); *H01H 2300/024* (2013.01); *H01H 2300/066* (2013.01)

(58) Field of Classification Search

CPC .. H01H 9/28; H01H 9/20; H01H 9/32; H01H 9/16; H01H 9/283; H01H 9/286; H01H 1/42; H01H 2300/066; H01H 2300/024; H01H 21/54

USPC ..... 200/43.11, 14, 16, 19, 21, 22, 439, 334

See application file for complete search history.

(56) References Cited

U.S. PATENT DOCUMENTS

| | | | | | |
|---|---|---|---|---|---|
| 2,813,938 | A * | 11/1957 | Speizman | H01H 9/286 | 200/43.21 |
| 3,689,718 | A * | 9/1972 | Gorsuch | H01H 9/226 | 200/61.62 |
| 4,467,152 | A * | 8/1984 | Gordy | H01H 9/283 | 200/43.15 |
| 4,733,029 | A * | 3/1988 | Kobayashi | H01H 9/283 | 200/43.15 |
| 5,310,969 | A * | 5/1994 | Turek | H01H 9/283 | 200/43.14 |
| 5,558,209 | A * | 9/1996 | Mohsen | H01H 9/283 | 200/43.11 |
| 5,732,815 | A * | 3/1998 | Brouwer | H01H 9/283 | 200/43.11 |
| 6,649,851 | B1 * | 11/2003 | Hennel | H01H 9/283 | 200/43.13 |
| 9,679,718 | B2 * | 6/2017 | Kubisiak | H01H 9/28 | |

* cited by examiner

*Primary Examiner* — William A Bolton

(74) *Attorney, Agent, or Firm* — Jeffrey Joyce, Esq.

(57) ABSTRACT

A switch blocking device that is insertable into an open switch that prevents the switch from being closed, the device being sized and shaped to fit securely in a space between an open blade of the switch and fixed electrical contacts of the switch, the device having a handle that enables easy insertion and removal while also covering the live electrical blade.

17 Claims, 8 Drawing Sheets

SWITCH BLOCKING DEVICE

BACKGROUND INFORMATION

Field of the Invention

The invention relates to electrical switches, such as those used with industrial control and metering systems, and more particularly, the invention relates to devices that are used to keep an electrical test switch open when it should not be closed.

Discussion of Prior Art

Electrical systems use some form of circuit isolator having a number of switches to allow operators to exert a degree of control over the flow of electricity. With industrial control and metering systems in particular, such as those found at electrical substations, power plants, oil rigs, industrial facilities, etc., test switches are commonly used to allow an operator to break the flow of electricity in order to perform testing or maintenance on certain electrical equipment.

FIG. 5 is an illustration that shows 10 traditional test switches, with 5 being in an open position and 5 being in a closed position. In general, these switches are mounted on a wall. Each switch includes a number of live electrical components including the switch blade B that's mounted in a hinge assembly A, and the contacts or jaws C. The blade has a non-conductive handle H and together the blade B and handle H open in an outward and downward manner in order to break the circuit the stop the flow of electricity. There is an open space between the blade and the contacts when the switch is open. The blade B, hinge assembly A, and contacts are and remain live electrical components.

Test switches, in particular, are critical with these types of systems because energizing equipment or starting up machinery that is being diagnosed or serviced could cause equipment damage and/or endanger the lives of those doing the work. To easily allow a break in the flow of electricity to certain equipment individual test switches may be opened by manually applying a small amount of force to the switch. Typically the switch opens easily by pulling the switch out and down. However, these switches close just as easily by applying a small amount of pressure by hand, or, more dangerously, by accidentally brushing against one as someone passes by.

Additionally, the open switches are a hazard even when they are not accidently closed. As noted, each side of the open switch is a live electrical contact. The space in these types of boxes is very limited, and it is relatively easy for wires and/or tools to accidentally contact an open switch, thereby closing or creating a connection that leads to an electrical accident.

While this dangerous scenario is somewhat common, there is no device that is designed to secure and cover the switch in the open position. Instead, operators typically place a piece of tape over an open switch. However, tape frequently falls off on its own if the adhesive is weak or if it not placed properly, and it also pulls off easily if someone accidently passes by and comes into contact with it.

What is needed, therefore, is a device that securely keeps an electrical switch open. What is further needed is a device that isolates the live electrical contacts while said electrical switch is in an open position.

BRIEF SUMMARY OF THE INVENTION

The invention is a switch blocking device that securely fits into a space created by opening a test switch in a circuit isolator. Circuit isolators are typically mounted on a wall or some form of vertically aligned panel or equipment. Each switch includes an openable blade that connects with a pair of electrical contacts. After a switch is opened the switch blocking device is placed into the opening created between the blade and contacts.

The switch blocking device is sized and shaped to fit securely in the opening between the blade and contacts, fitting in the opening in a manner similar to a puzzle piece, and staying in position as a result of the fit and with the effect of gravity. More specifically, the switch blocking device has a blocking wedge that fits in the open space, and a pair of arms that extend on either side of the blade.

A handle extends upward in a direction opposite the wedge to allow a user to easily insert and remove the device, and also provides a cover over the blade and hinge assembly. As the blades are live electrical contacts and extend out and away from the switch when open they provide an additional hazard as workers are frequently working around these open switches with electrically conductive tools and wires that may accidently contact the open blade.

While the size and shape of the switch blocking device secures the device in the open switch, additional openings are also provided near the ends of the arms so that users may further secure the device around the blade with a conventional fastener.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
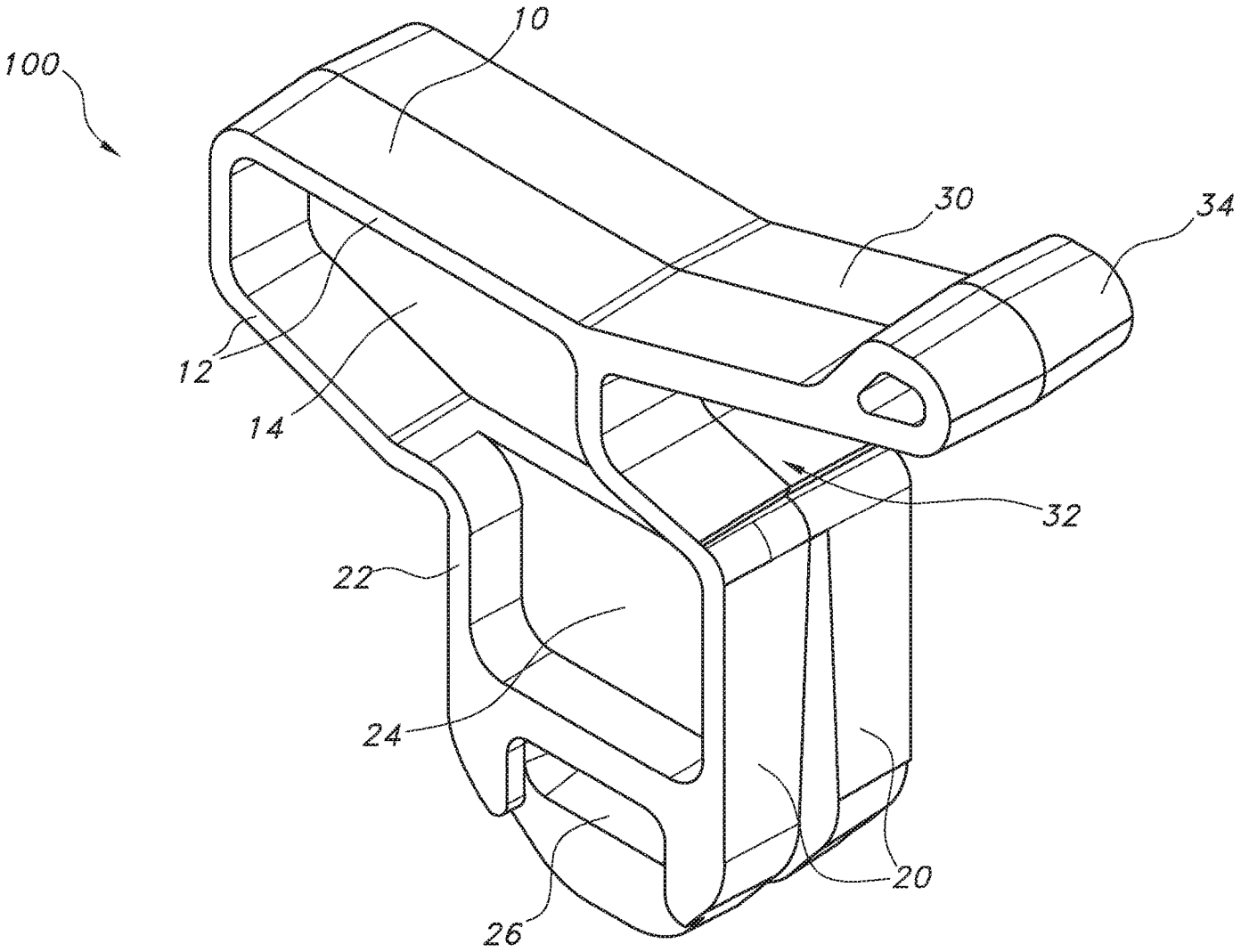
FIG. 1 is a front perspective view of the blocking device according to the invention.
Figure 2:
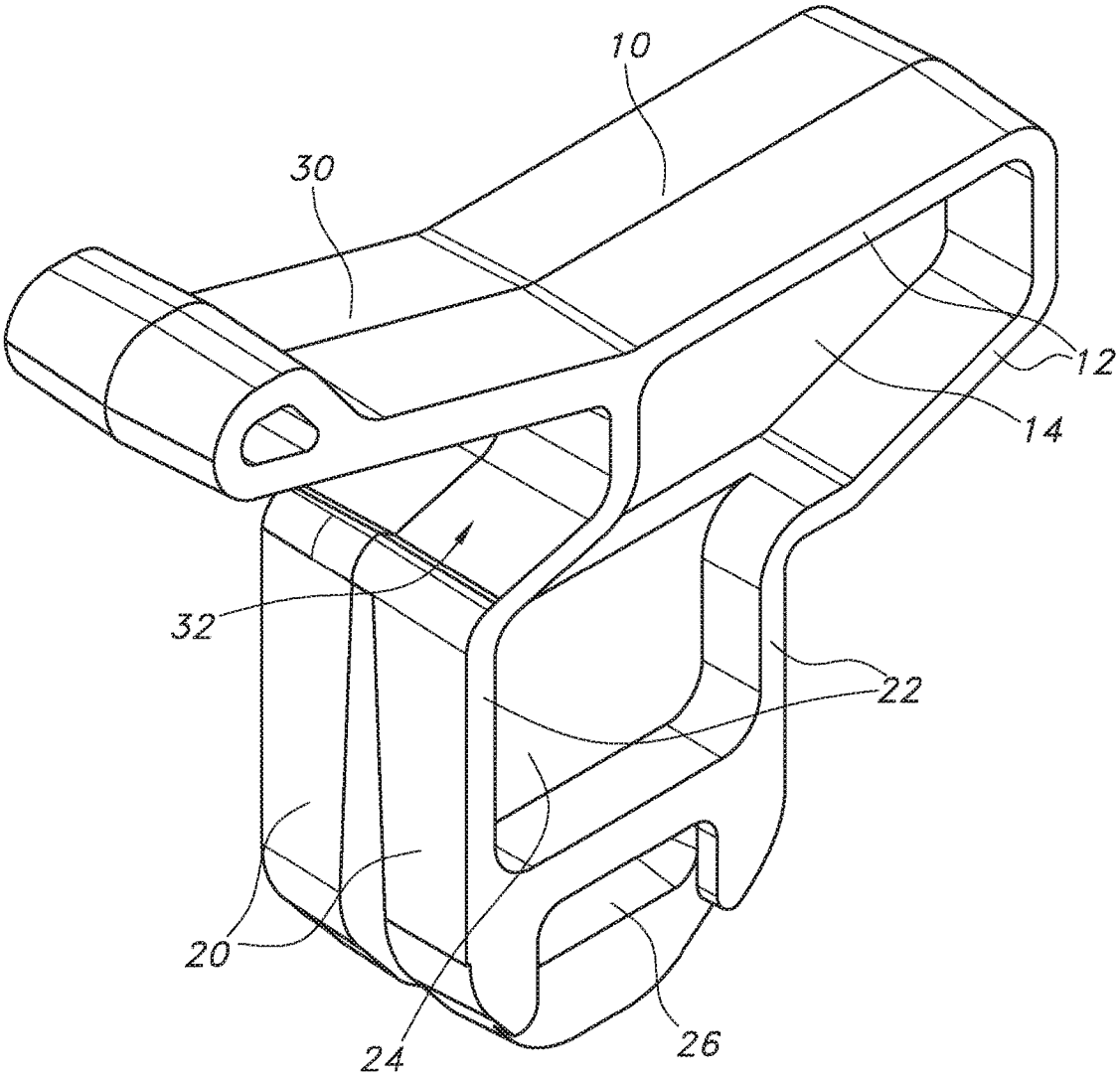
FIG. 2 is a rear perspective view of the blocking device.
Figure 3:
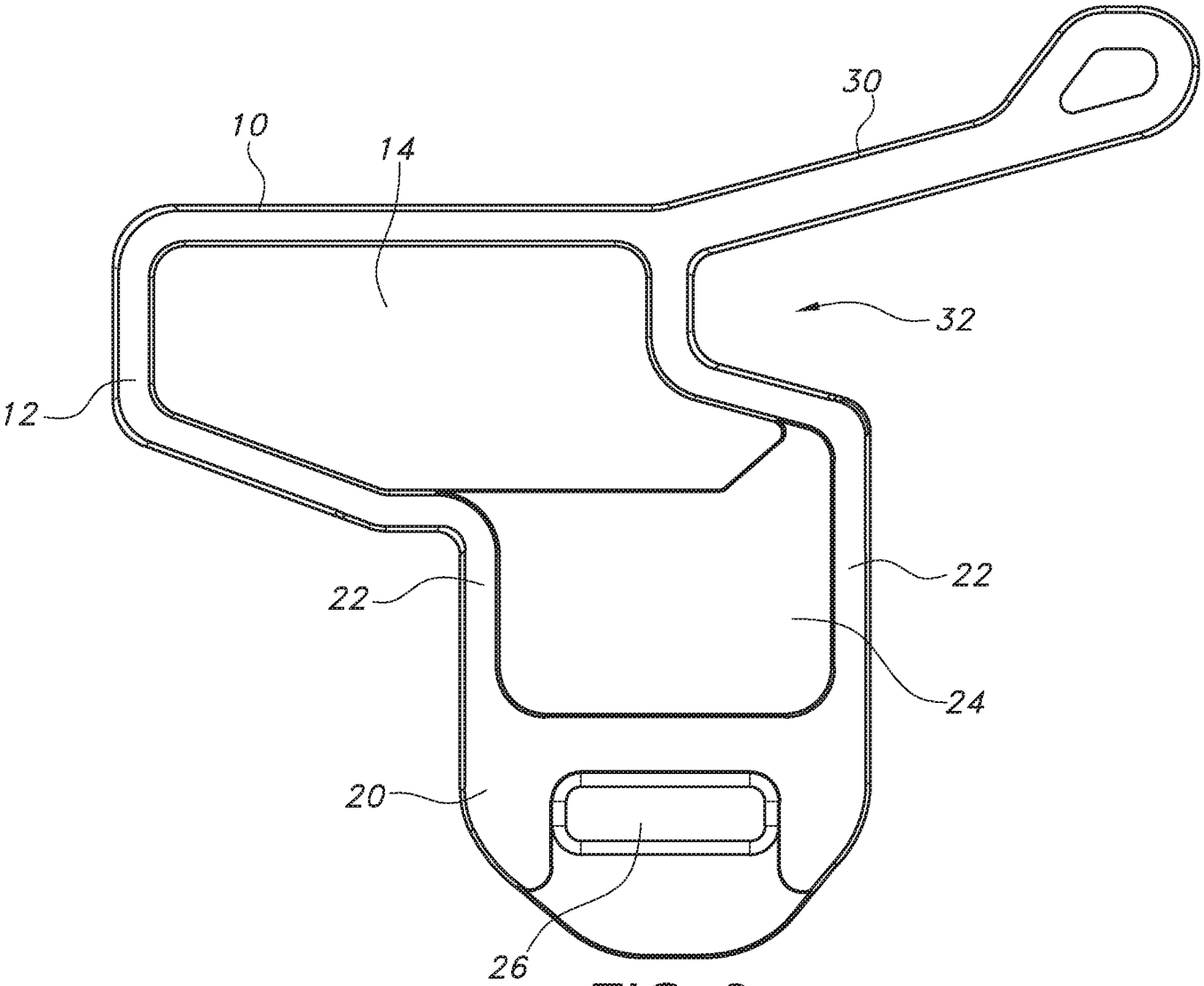
FIG. 3 is a side view of the blocking device.
Figure 4:
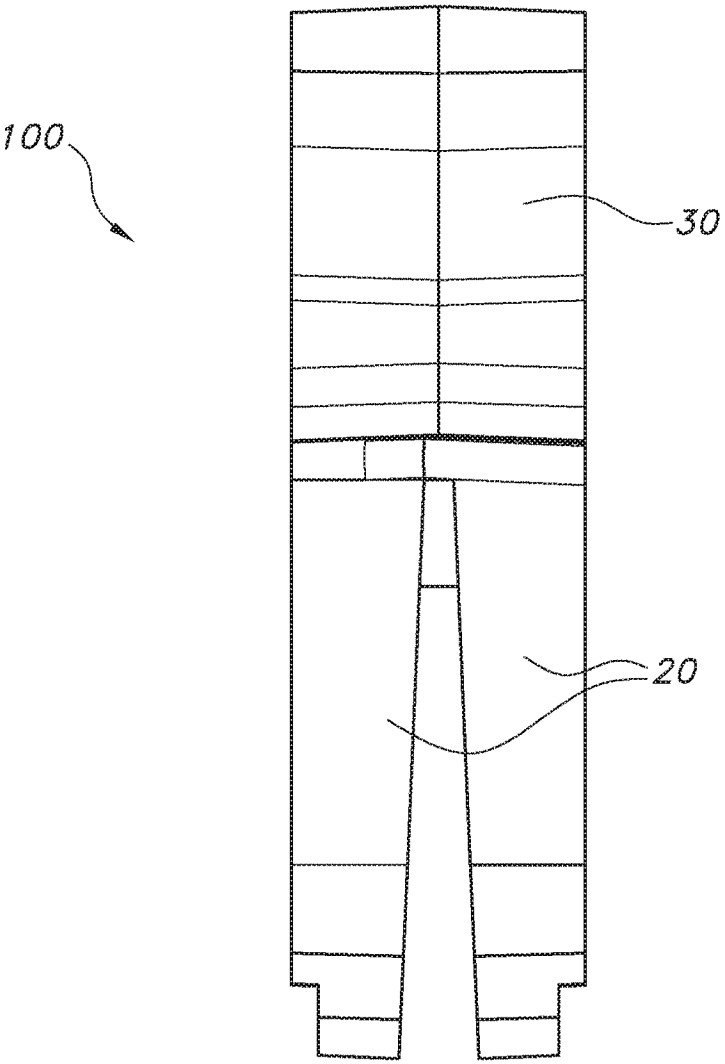
FIG. 4 is a front view of the blocking device.
Figure 5:
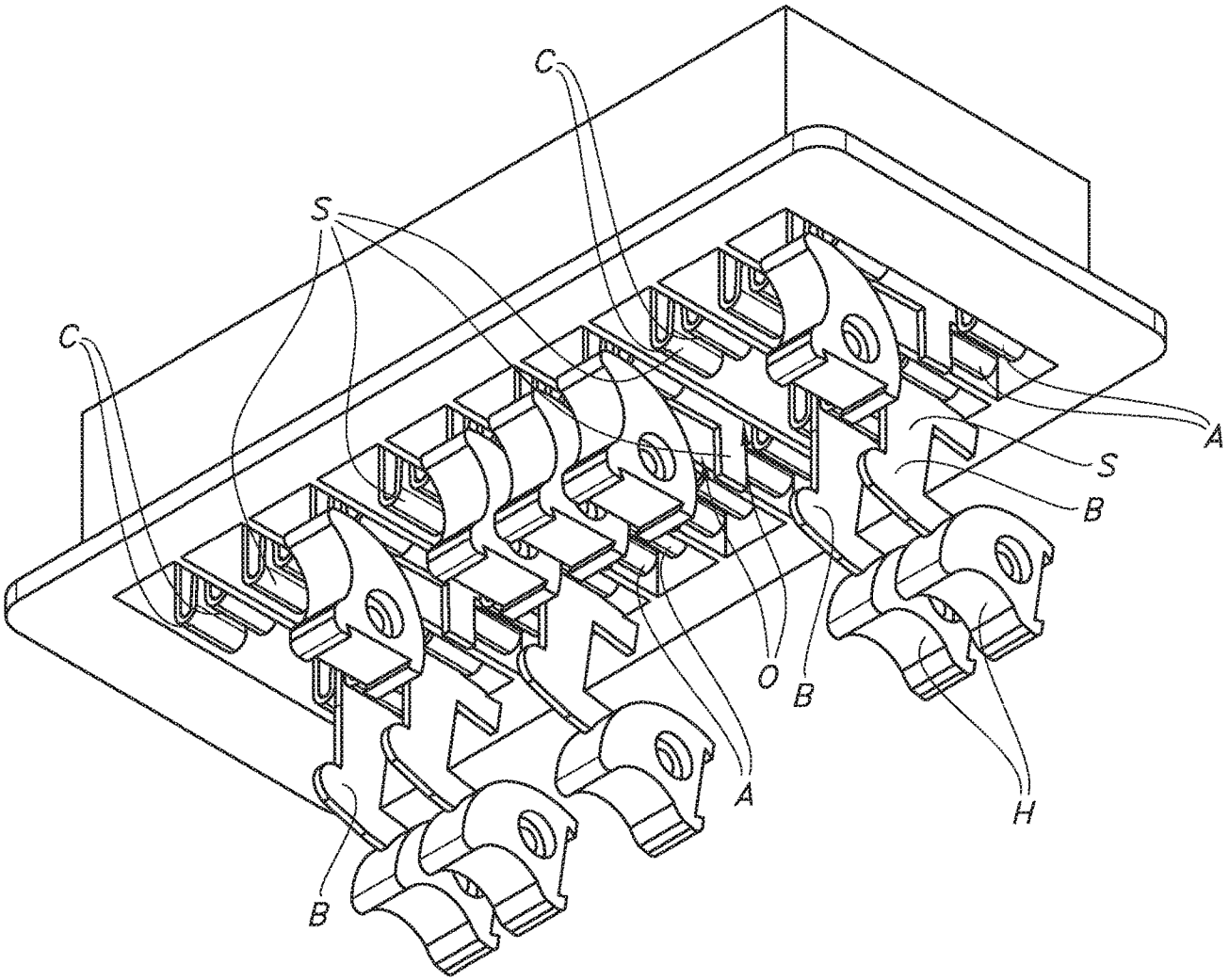
FIG. 5 is top view an example set of test switches.
Figure 6:
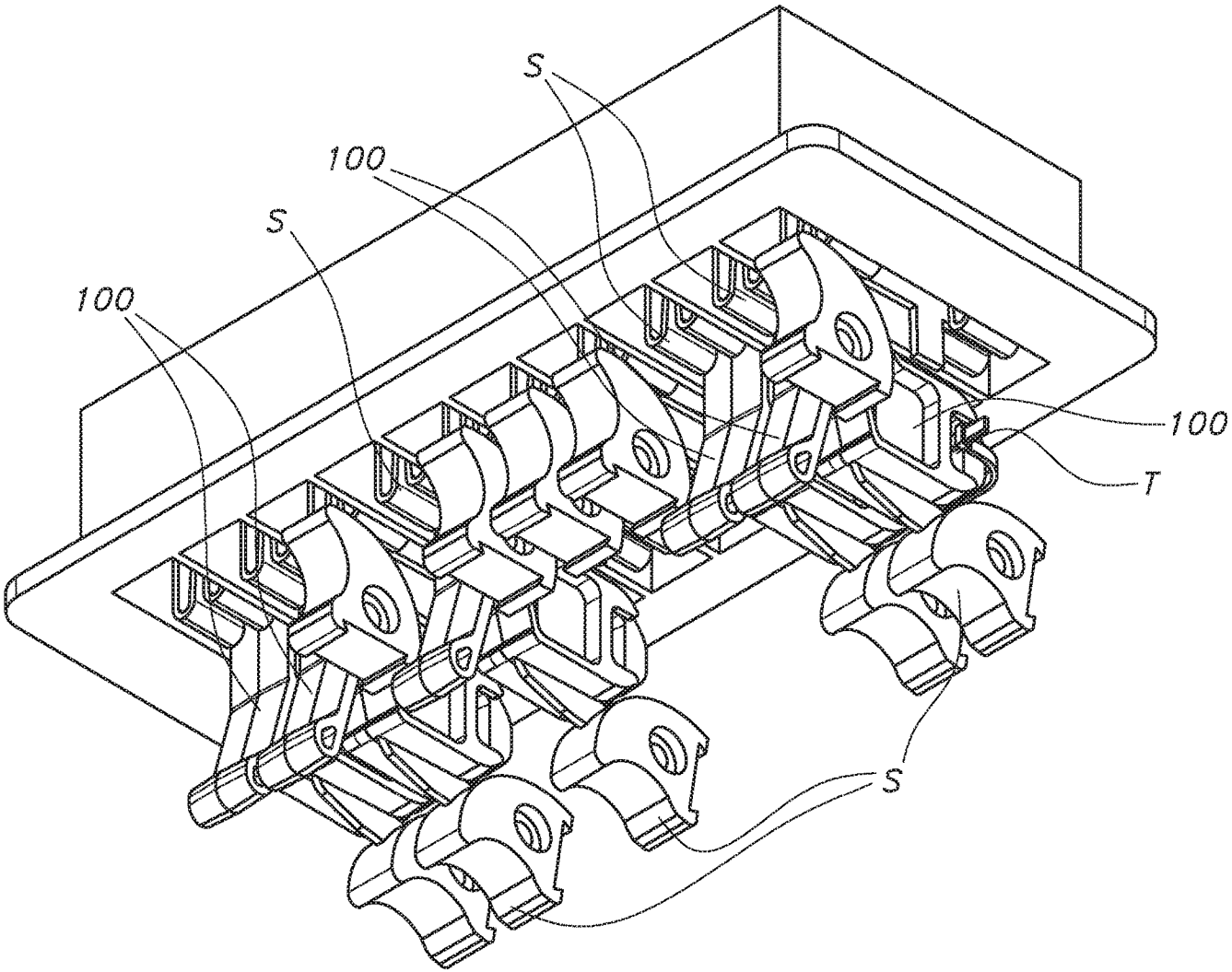
FIG. 6 is to view an example of the blocking device in use on a number of test switches.
Figure 7:
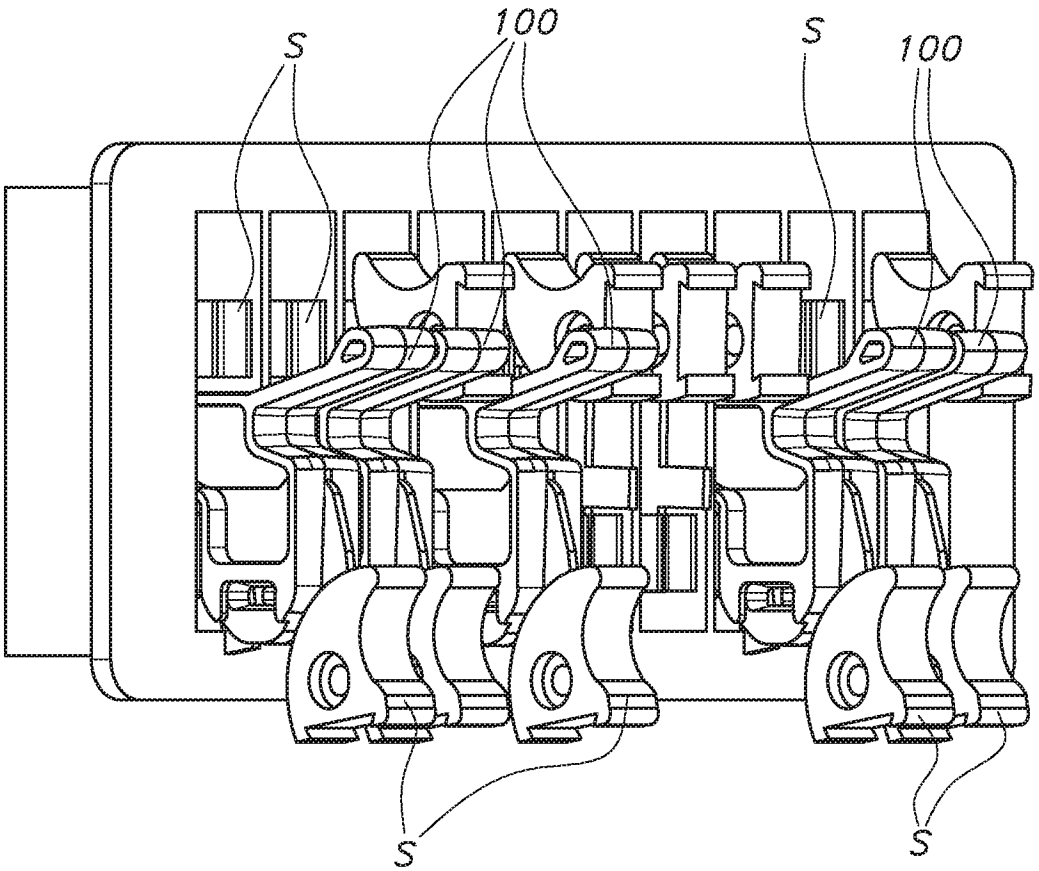
FIG. 7 is a top perspective view of five blocking devices in use.

FIGS. 1-4 illustrate the switch blocking device 100 according to the invention, including a blocking wedge 10 and blocking arms 20. After a switch S that has an openable blade B that is movably connected to a hinge assembly A, and a set of contacts C, shown in FIGS. 5-7, is opened, the blocking device 100 is inserted into the opening O, with the wedge 10 fitting into the space vacated by the open side of the switch S and the arms 20 surrounding the blade B and covering the hinge assembly A of the switch S. The device 100 also has a handle 30 to allow an operator to easily insert and remove the device 100 and to cover the blade so as to prevent accidental or incidental contact with, for example, nearby tools and/or wires.

Figure 8:
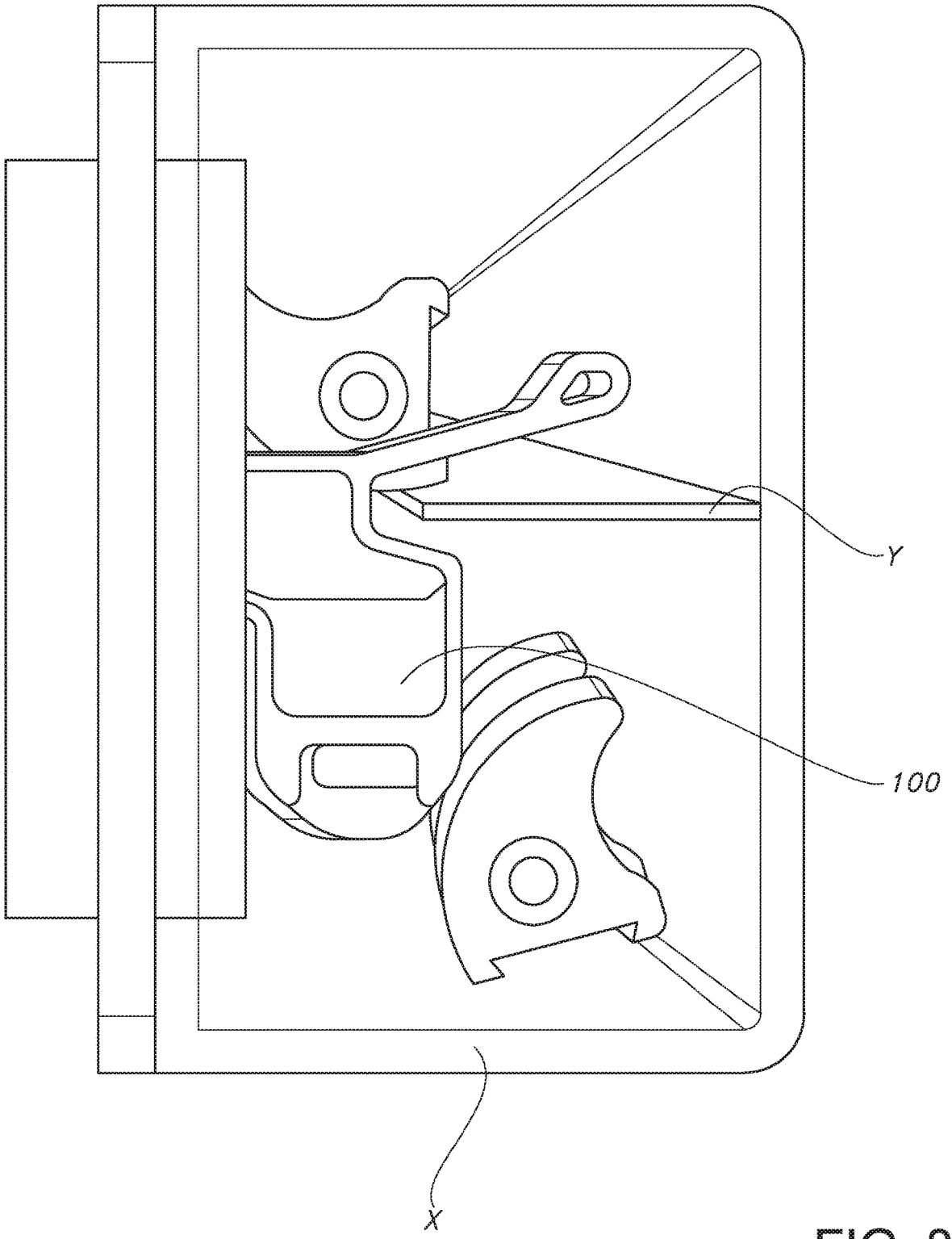
FIG. 8 is a side view of a set of switches under a switch cover.

In the embodiment shown, the arms 20 form a tapered "U" shape to allow for easy and secure insertion around the open side of the switch S. There is also a tapered gap 32 between the handle 30 and the wedge 10 that allows a test switch cover X, shown in FIG. 8, which commonly includes a horizontally oriented bar Y that extends downward into the switch area, to be installed while the device 100 is in place blocking the switch S.

Also in the embodiment shown, the wedge 10 and arms 20 have outer sides, 12, 22, that are wider than inner portions 14, 24, of the wedge 10 and arms 20, which reduces the weight of the device as well as the amount of material that is required to manufacture the device. The outer sides 12, 22, are sized and shaped to create a secure fit when the device 100 is inserted into the open switch S. As shown in the figures, the outer sides 12, 22 are fairly straight leading down to the narrow inner portions 14, 24, however, the shape of the outer sides 12, 22, is largely a manufacturing decision and other shapes are also acceptable. For example, the outer sides 12, 22 may be tapered.

The device is made of an electrically insulating material, for example, a thermoplastic such as acrylonitrile butadiene styrene (ABS) or polylactide (PLA), and thus creates an electrical block to any electrical charge in addition to the physical block of the electrical charge created by the wedge 10 and arms 20.

Openings 26 near the bottom of each arm 20 allow an operator to further secure the device 100 by use of a conventional fastener T, such as a cable tie or zip tie, an example of which is shown in FIG. 6. The fastener is made of an electrically insulating material.

The device is dimensioned to allow it to fit securely into the typical test switch, the width such that the device fits snuggly without wobbling within the test switch S. The arms 20 are of the sufficient length to clear the blade of the switch S. The arms 20 may also end with a taper to aid in clearing the switch 30 blade. The end of the handle 30 may have a small knob or grip 34 to aid in device 100 extraction.

It is understood that the embodiments described herein are merely illustrative of the present invention. Variations in the construction of the switch blocking device may be contemplated by one skilled in the art without limiting the intended scope of the invention herein disclosed and as defined by the following claims.

What is claimed is:

1. A switch blocking device adapted to keep an electrical switch open, the switch blocking device comprising:

blocking arms and a blocking wedge, the blocking wedge having an outer edge and an inner portion, the inner portion being narrower than the outer edge, the blocking wedge fitting into a space in the electrical switch that is made accessible by opening the electrical switch, the blocking arms fitting around and covering an electrically conductive open arm of the electrical switch when the blocking wedge is inserted into the space in the electrical switch;

wherein the electrical switch is not closable when the switch blocking device is inserted into the open electrical switch.

2. The switch blocking device of claim 1, further comprising a handle that allows a user to insert and remove the blocking device and that extends over the open arm of the electrical switch.

3. The switch blocking device of claim 2, further including a tapered gap between the handle and the blocking wedge that enables a cover to be placed over the electrical switch.

4. The switch blocking device of claim 1, wherein the switch blocking device is made of an electrically insulating material.

5. The switch blocking device of claim 1, further comprising openings in the blocking arms that are sized to accept a fastener.

6. The switch blocking device of claim 1, wherein the blocking arms have outer edges and inner portions, the inner portions being narrower in width than the outer edges.

7. A switch blocking device adapted to keep an electrical switch open, the electrical switch including an electrically conductive blade that is moveably connected to an electrical hinge assembly and electrically conductive contacts, the switch blocking device comprising:

a blocking wedge and blocking arms, the blocking wedge having an outer edge and an inner portion that is narrower than the outer edge, the blocking wedge fitting into a space in the electrical switch that is made accessible by opening the electrical switch, the blocking arms fitting around and covering the blade and hinge assembly when the blocking wedge is inserted into the space in the electrical switch;

wherein the electrical switch is not closable when the switch blocking device is inserted into the open electrical switch.

8. The switch blocking device of claim 7, further comprising a handle that allows a user to insert and remove the blocking device and that extends over the open arm of the electrical switch.

9. The switch blocking device of claim 7, wherein the switch blocking device is made of an electrically insulating material.

10. The switch blocking device of claim 7, further comprising openings in the blocking arms that are sized to accept a fastener.

11. The switch blocking device of claim 7, wherein the blocking arms have outer edges and inner portions, the inner portions being narrower in width than the outer edges.

12. The switch blocking device of claim 11, further including a tapered gap between the handle and the blocking wedge that enables a cover to be placed over the electrical switch.

13. A switch blocking device adapted to keep an electrical switch open, the switch blocking device comprising:

a blocking wedge and blocking arms, the blocking wedge fitting into a space in the electrical switch that is made accessible by opening the electrical switch, the blocking arms fitting around and covering an electrically conductive open arm of the electrical switch when the blocking wedge is inserted into the space in the electrical switch;

a handle that allows a user to insert and remove the blocking device and that extends over the open arm of the electrical switch;

a tapered gap between the handle and the blocking wedge that enables a cover to be placed over the electrical switch; and wherein the electrical switch is not closable when the switch blocking device is inserted into the open electrical switch.

14. The switch blocking device of claim 13, wherein the switch blocking device is made of an electrically insulating material.

15. The switch blocking device of claim 13, further comprising openings in the blocking arms that are sized to accept a fastener.

16. The switch blocking device of claim 13, wherein the blocking wedge has an outer edge and an inner portion that is narrower than the outer edge.

17. The switch blocking device of claim 16, wherein the blocking arms have outer edges and inner portions, the inner portions being narrower in width than the outer edges.

* * * * *